US006874679B2

(12) United States Patent
Tibbles et al.

(10) Patent No.: US 6,874,679 B2
(45) Date of Patent: Apr. 5, 2005

(54) CONTAINER HAVING SLIDING CORNER SUPPORT

(75) Inventors: Brian J. Tibbles, Levittown, PA (US); Peter S. Jaffe, Philadelphia, PA (US); Andrew Sypawka, Doylestown, PA (US)

(73) Assignee: Innovative Packaging Designs, L.P., Montgomeryville, PA (US)

( * ) Notice: Subject to any disclaimer, the term of this patent is extended or adjusted under 35 U.S.C. 154(b) by 0 days.

(21) Appl. No.: 10/269,228

(22) Filed: Oct. 11, 2002

(65) Prior Publication Data

US 2003/0071114 A1 Apr. 17, 2003

Related U.S. Application Data

(60) Provisional application No. 60/329,117, filed on Oct. 12, 2001.

(51) Int. Cl.[7] ..... B65D 5/06

(52) U.S. Cl. ..... 229/122.33; 229/191; 229/122.33; 229/120.11; 229/185.1

(58) Field of Search ..... 229/191, 122.33, 229/120.11, 122.32, 185.1

(56) References Cited

U.S. PATENT DOCUMENTS 3,375,967 A * 4/1968 Robinson ..... 229/178
3,731,873 A 5/1973 Brangle, Jr. ..... 229/41
4,418,863 A * 12/1983 Kimbrell, Sr. ..... 229/169
4,883,221 A * 11/1989 Brundage ..... 229/143
5,125,568 A * 6/1992 Bauer ..... 229/172
5,285,956 A * 2/1994 Piepho ..... 229/191
5,294,044 A * 3/1994 Clark ..... 229/191
5,452,848 A * 9/1995 Mur Gimeno ..... 229/191
6,158,653 A * 12/2000 Kanter et al. ..... 229/185.1
6,296,178 B1 * 10/2001 McKenna, Sr. ..... 229/165
6,641,032 B1 * 11/2003 Schilling ..... 229/174

* cited by examiner

*Primary Examiner*—Tri M. Mai
(74) *Attorney, Agent, or Firm*—Synnestvedt & Lechner LLP

(57) ABSTRACT

A container having multiple wall panels forming container sides, the container having at least first and second wall panels that meet at a first corner. The container is assembleable from a flat or knockdown state to an opened or assembled state. A first inner panel is attached to a first wall panel, the first inner panel having an end spaced from the first corner. A slidable corner support is attached to the end of the first inner panel and extends towards the second wall panel. When the container is assembled from the knockdown state, the slidable corner support moves away from the first corner to form a support member that can help support a container stacked on top and prevent nesting.

20 Claims, 12 Drawing Sheets

FIG.9
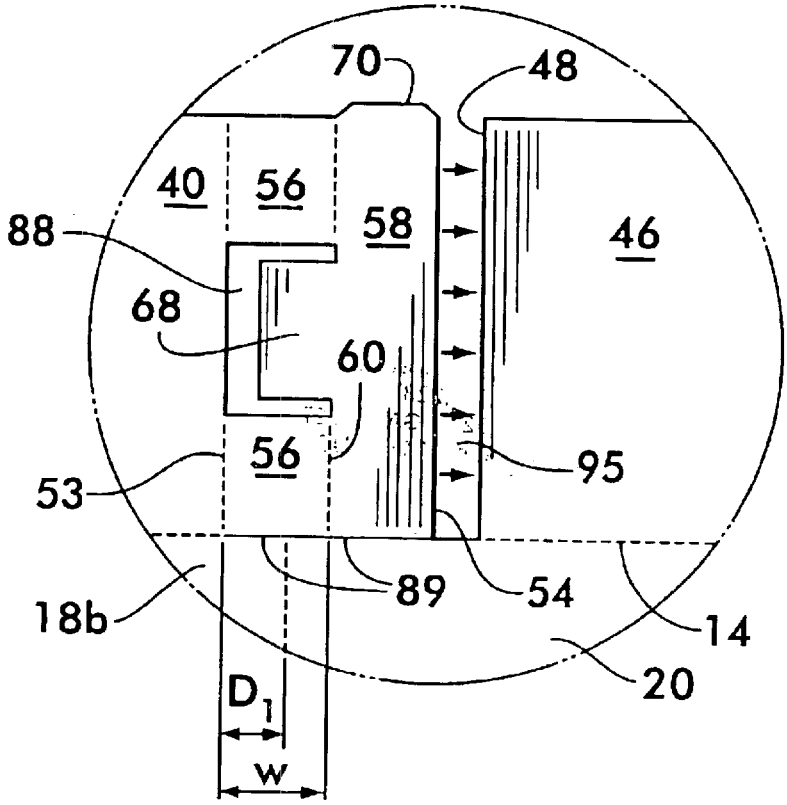
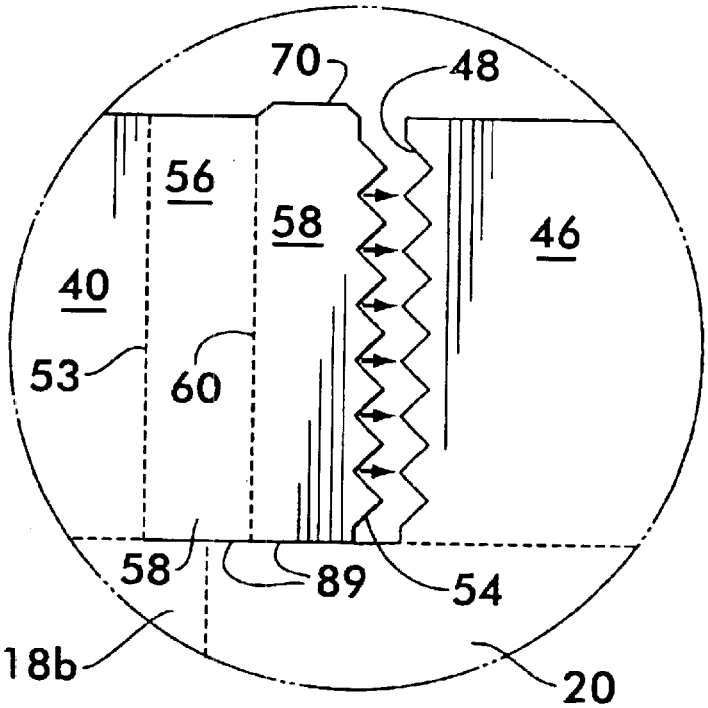
FIG.13

CONTAINER HAVING SLIDING CORNER SUPPORT

CROSS REFERENCE TO RELATED APPLICATION

This application claims the benefit of U.S. Provisional Application No. 60/329,117 filed Oct. 12, 2001 which is hereby incorporated herein by reference.

BACKGROUND

1. Field of the Invention

The present invention pertains to containers and boxes used for packaging, shipping, and displaying goods. More particularly, the invention relates to display containers having means to facilitate the stacking of such containers on top of one another.

2. Description of the Related Art

Display containers are widely used for shipping and marketing products. Such containers are especially popular in warehouse-type marketing settings and supermarkets where many containers are opened to display the food or merchandise within and can be stacked one on top of another. Examples include containers of packaged candy which may be decorated for display purposes. The containers of candy are shipped to the store in stacked form. Store personnel remove any display panels to allow the candy within to be seen and removed, and the containers are then stacked one on top of another on the retail floor.

A major problem with previously known display containers is their lack of strength for stacking. All too often, loaded and stacked containers collapse or become misshaped due to the combined weight of the containers and products contained therein. This impairs the aesthetic appearance of the display sought by the seller and damages the products within. Another problem is where one container nests into the container on top of which it is stacked. Here, a corner or bottom edge of the top container "nests" or falls into the container below.

Typical containers are made from a die cut piece of single layer corrugated paperboard. Such construction has proven unsatisfactory for display use where removal of the top and any display cutout weakens the container sidewalls which bear the weight of a stacked group of containers. Collapse and/or warping results.

Methods of producing stronger containers are known. For example, double walled corrugated containers are stronger than single walled corrugated containers. This added strength, however, adds additional manufacturing costs and creates more waste product for eventual disposal. Moreover, because the container is formed from a single die cut piece of corrugated paperboard, all parts of the container will be made of the double layer board, including the bottom forming panels which do not always need the added strength. This wastes natural resources used to make the container and adds unnecessary manufacturing costs.

Another consideration is the assembly and filling of containers by automatic machinery. Various types of configurations for improving the stacking strength of containers may not be compatible with containers that are opened or assembled from a flat configuration, also known as a knockdown form.

Accordingly, an object of the present invention is to provide a means for improving the stacking strength of containers.

Another objective is to provide means for improving stacking strength that is compatible with containers used on automatic fill lines where the containers are opened from a collapsed or knockdown form.

Additional objects, advantages and novel features of the invention will be set forth in part in the description which follows, and in part will become apparent to those skilled in the art upon examination of the following or may be learned by practice of the invention.

SUMMARY OF THE INVENTION

The present invention provides a container having multiple wall panels forming the container sides, the wall panels including first and a second wall panels which meet one another at a first corner. The container is assembleable from a knockdown state (substantially flat state) to an opened state. The knockdown state has a first and a second knockdown wall where the first knockdown wall includes the first and second wall panels substantially parallel to one another in a substantially same plane. The first and second wall panels are folded relative to one another at the first corner during the assembly of the container from the knockdown state. A first inner panel is attached to the first wall panel and has an end spaced from the first corner. A slidable corner support is attached to the end of the first inner panel and extends towards the second wall panel, the support member overlapping the first corner when the container is in the knockdown state. The slidable corner support has an end slidable relative to the second wall panel when the container is assembled from the knockdown state, and the slidable corner support moves away from the first corner as the container is assembled from the knockdown state.

BRIEF DESCRIPTION OF THE DRAWINGS

The foregoing summary and the following detailed description may be better understood when read in conjunction with the accompanying drawings. Various embodiments are shown for the purpose of illustrating the invention. It is understood, however, that this invention is not limited to the precise arrangements shown.

FIG. 9 is an enlarged view of the slide corner of the blank in FIG. 8;

FIG. 13 is an alternative embodiment of a slidable corner support.

DETAILED DESCRIPTION

Figure 1:
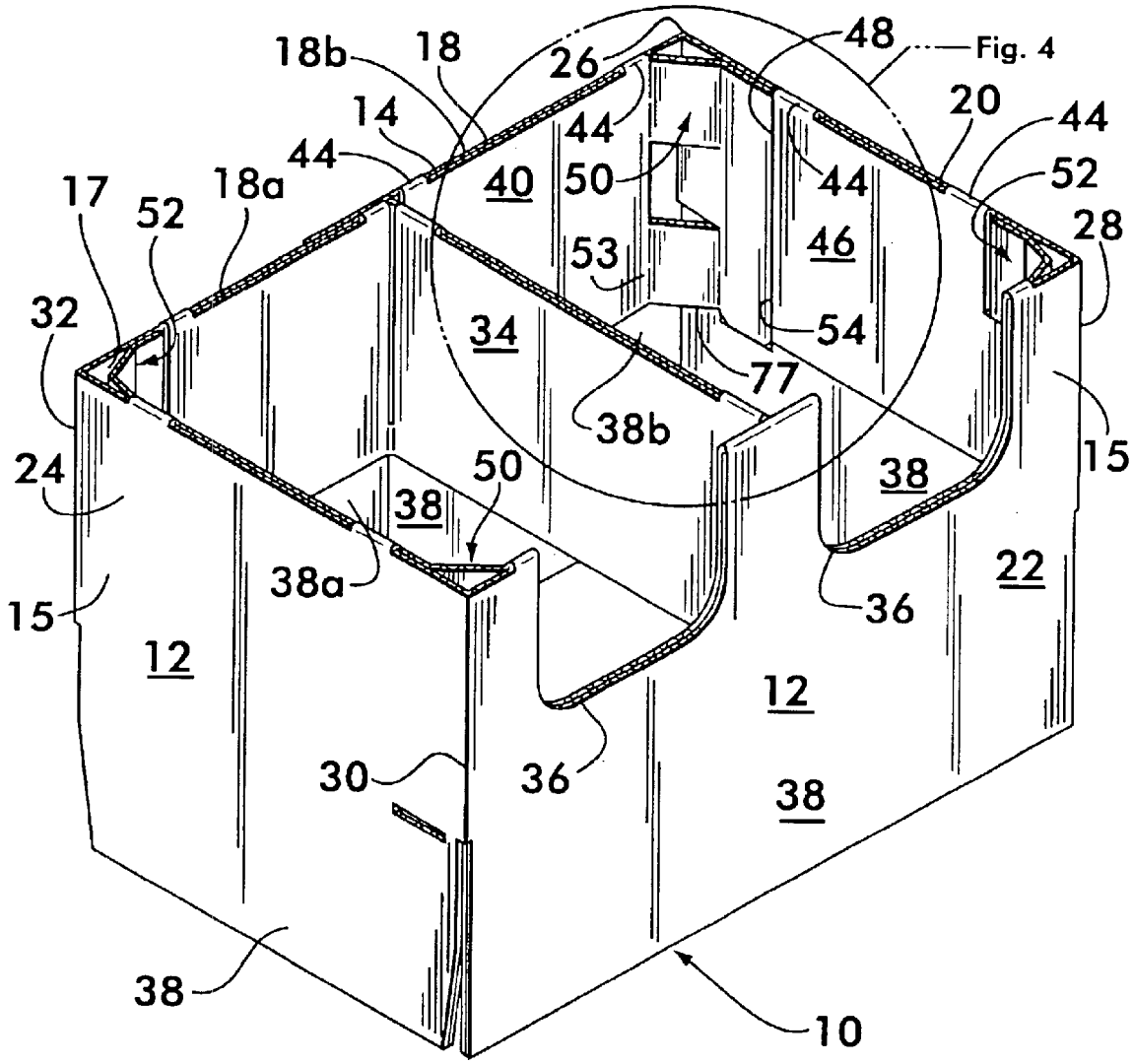
FIG. 1 is a perspective view of a container made in accordance with the present invention, the bottom flaps being in an unfolded position.
Figure 2:
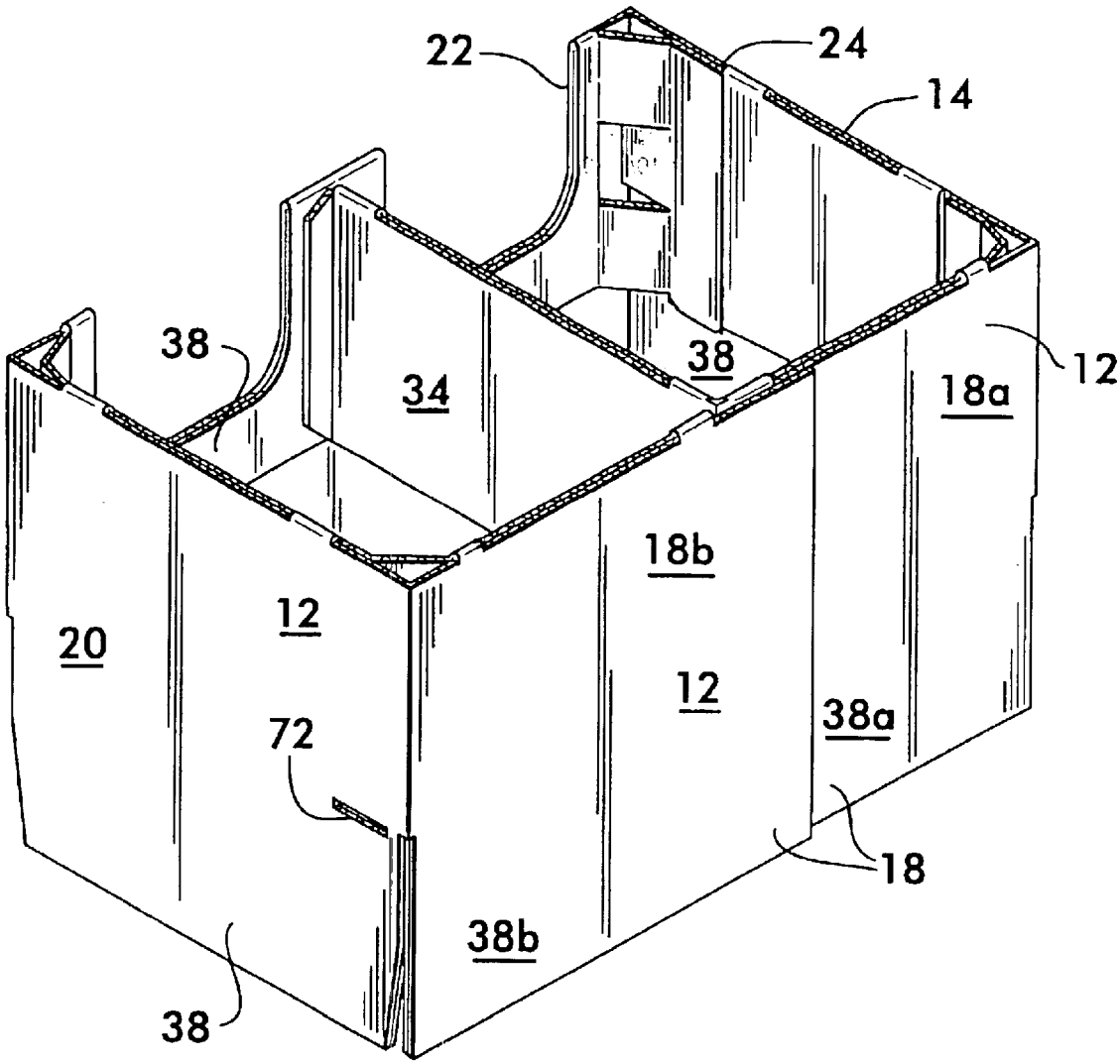
FIG. 2 is another perspective view of the container shown in FIG. 1.
Figure 3:
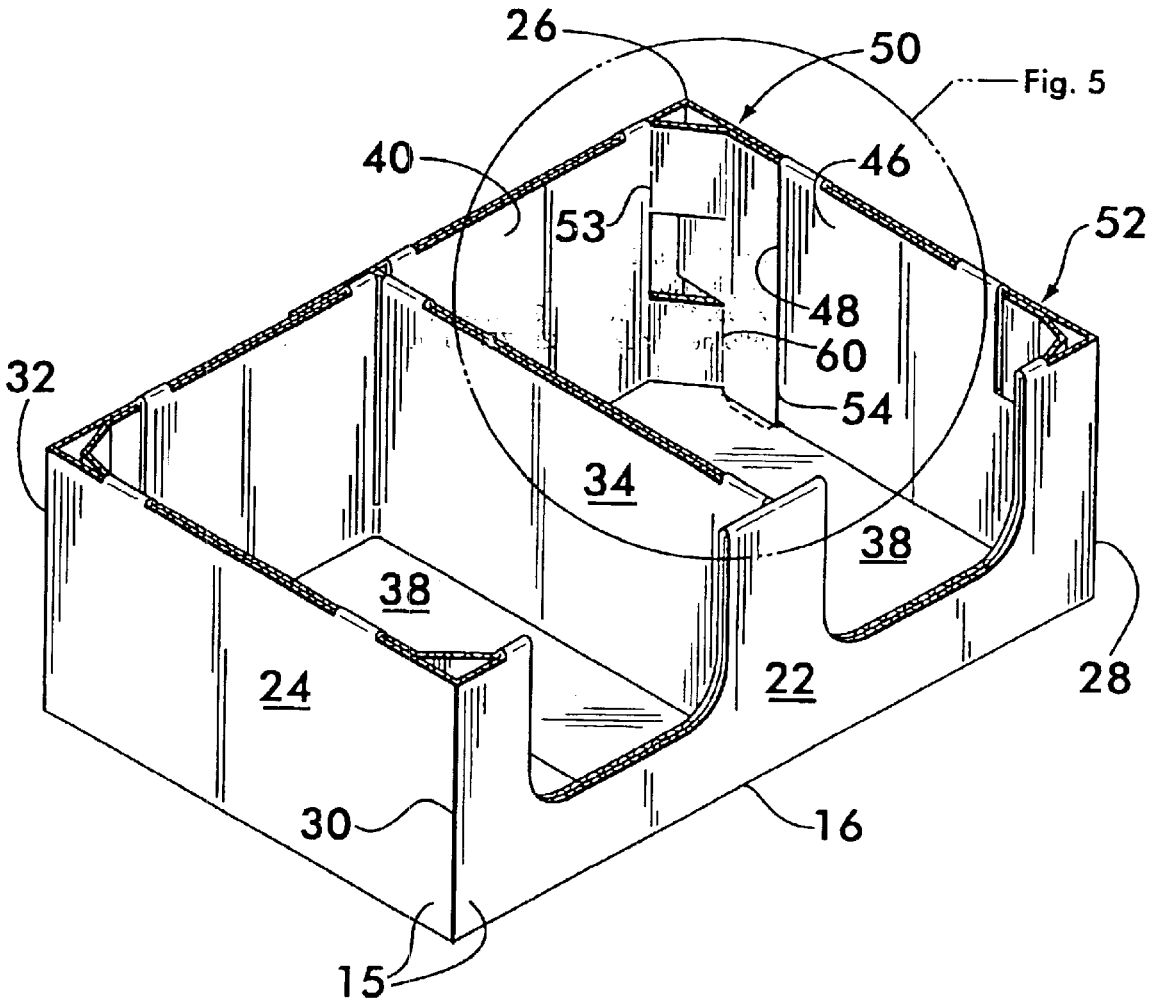
FIG. 3 is another perspective view of the container shown in FIG. 1 with the bottom flaps folded.

The invention disclosed herein is for a container having a novel means of strengthening for stacking and preventing nesting. In particular, the corners of the container are reinforced in a novel manner using a slidable corner that is compatible with automatic machinery. Described below is a preferred embodiment particularly suited for display-ready containers. It is recognized, however, that the present invention is adaptable to containers used for other purposes.

With reference to FIGS. 1, 2, 3, 4, and 5, a container 10 is shown having multiple wall panels 12 integrally attached to one another to form the container sides. Each wall panel 12 has a top end 14, a bottom end 16 (FIG. 3), an outer face 15 and an inner face 17 facing towards the inside of the container 10 as shown. In this particular example, the multiple wall panels 12 include a first wall panel 18, a second wall panel 20, a third wall panel 22, and a fourth wall panel 24. The first wall panel 18 is formed from two partial panels 18*a*, 18*b* glued together during the manufacturing process in a manner known in the art (see FIG. 2).

The first and second wall panels 18 and 20 meet and are attached to one another at a first corner 26; the second and third wall panels 20 and 22 at a second corner 28; the third and fourth wall panels 22 and 24 at a third corner 30; and the fourth and first wall panels 24 and 18 at a fourth corner 32.

A divider wall 34 integrally attached to and extending from an end 35 (FIG. 8) of the partial wall panel 18*a* and adhesively attached to the third wall panel 22 divides the container 10 into two sections as shown. Two display openings 36 provide visual display and access to the two sections formed by the divider wall 34.

Integrally attached along the bottom end 16 of the side wall panels 12 is a bottom formed by multiple bottom flaps 38. Partial bottom flaps 38*a* and 38*b* integrally attached to partial wall panels 18*a*, 18*b*, respectively, form the bottom flap 38 attached to the wall panel 18 (See FIGS. 2, 8). Many different types of container bottoms are known in the art, any suitable bottom may be used.

A first inner panel 40 is attached to the inner face 17 of the first wall panel 18 (18*b*) in a face to face relationship as shown. The first inner panel 40 has an end 42 spaced from the first corner 26 (see FIG. 4). In the present embodiment, the first inner panel 40 takes the form of a reinforcing panel covering a substantial portion of the inner face 17 of the wall panel 18*b*, thereby providing a double wall structure for added strength. While such a large reinforcing panel offers added strength and works well with the illustrated embodiment, it is not required. The first inner panel 40 could be smaller in width, although a suitable width for adequate gluing and strength should be maintained. The first inner panel 40 shown is integrally attached to the top end 14 of the first wall panel 18 at areas 44, and can be adhered, such as with glue, to the inner face 17 of the first wall panel section 18*b*.

A second inner panel 46 is attached to the inner face 17 of the second wall panel 20 in a face to face relationship as shown. The second inner panel 46 has an end 48 spaced from the first corner 26. As with the first inner panel 40, the second inner panel 46 takes the form of a reinforcing panel covering a substantial portion of the inner face 17 of the wall panel 20, thereby providing a double wall structure for added strength. The second inner panel 46 is attached to the top end 14 of the first wall panel 18 at areas 44, and can be adhered, such as with glue, to the inner face 17 of the second wall panel 20.

As best illustrated in FIGS. 1, 2, 3, 4, and 5, slidable corner supports 50 are provided at corners 26 and 30 to improve stacking strength and minimize nesting. Other types of corner supports 52 are provided at corners 28 and 32 which are described in U.S. Pat. No. 6,158,653 and which is hereby incorporated herein by reference. These other corner supports 52 are optional. The slidable corner support members 50 reinforce the corners 26 and 30 and provide a second support surface in addition to the top ends of the corners 26, 30 for supporting a container stacked on top. While all corners of the container 10 are shown with a corner support, it is readily understood that other embodiments having less than all corners reinforced are possible.

Figure 4:
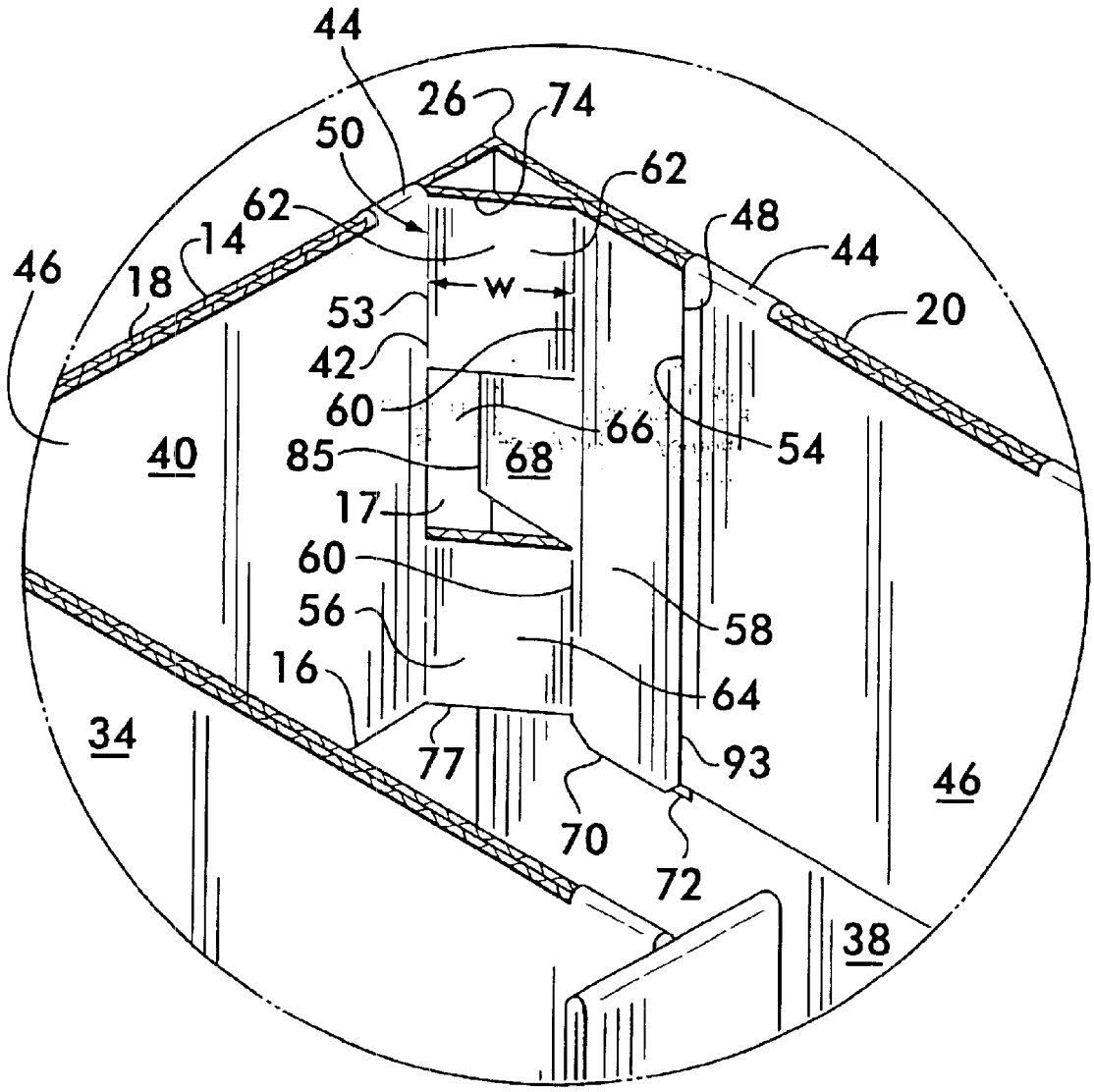
FIG. 4 is an enlarged view of the slide corner of the container shown in FIG. 1.
Figure 5:
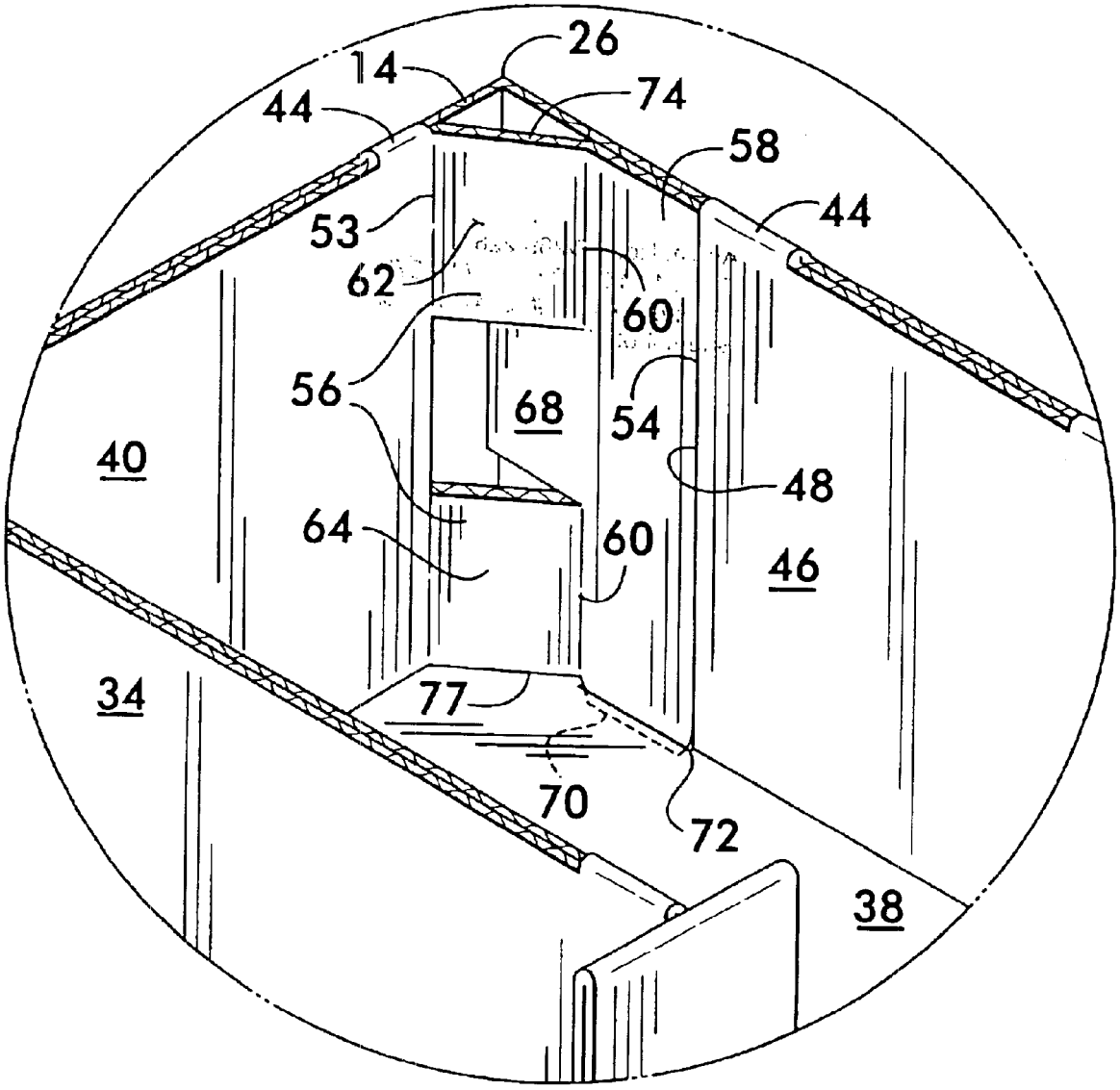
FIG. 5 is an enlarged view of the slide corner of the container shown in FIG. 3 with the bottom flaps folded.

As both slidable corner supports 50 are similar, only the slidable corner support 50 at the corner 26 is described below. With reference to FIGS. 1, 4 and 5, the slidable corner support 50 is attached to the end 42 of the first inner panel 40 and extends toward the second wall panel 20. A fold line 53 preferably defines the end 42 and separates the slidable corner support 50 from the first inner panel 40. As will be shown below, the corner support 50 overlaps the corner 26 when the container is in a knockdown or flat configuration, and moves to a position away from the corner 26 as shown in FIG. 4 when the container is in the open or assembled configuration. Further, the corner support 50 has a free end 54 slidable relative to the second wall panel 20 as the container is being assembled, FIG. 4 showing the free end 54 against the second wall panel 20, and abutting the end 48 of the second inner panel 46, the end being free to move during the assembly process.

In the preferred embodiment illustrated, the slidable corner support 50 is formed of two sections, a first section 56 and a second section 58. The two sections 56 and 58 are foldable relative to one another about a fold line 60 which is substantially parallel to a line defined by the corner 26 extending from the bottom of the container to the top and which fold line 60 is positioned between the end 42 of the first inner panel 40 and the free end 54 of the corner support 50. The first section 56 overlaps the corner 26 when the container is in the knockdown state so as to be able to move away from the corner 26 during assembly of the container 10 as further described below. Thus, a width w of the first section 56 is greater than a distance $D_1$ from the end 42 of the first inner panel 40 to the corner 26 when the container is in the knockdown state (FIG. 9).

The first section 56 of the slidable corner 50 can further include a top section 62 and a bottom section 64 spaced from one another so as to define an open area 66. A buttress tab 68 extending from the second section 58 towards the corner 26 between the top and bottom sections 62 and 64 in the open space 66 and formed as a cut out from the first section 56 prevents the slidable corner 50 from slipping back and collapsing due to internal pressure from product within the container 10. A tab 70 can be provided to lock into an opening 72 in the bottom flap when the bottom flap is folded to further anchor the corner 50 in place (see FIG. 5).

Preferably, the top edge 74 of the slidable corner supports 50 is co-elevational with the top end 14 of the wall panels 12 to provide an additional support surface for a container stacked on top. Likewise, it is preferred, that the bottom end 77 of the slidable corner supports 50 be supported for added strength by another member of the container 10, such as by the bottom flap 38 as shown in the illustrated embodiment which supports a substantial portion of the bottom end 77 of the slidable corner support 50. In the illustrated embodiment, the corner sections 56, 58 are shown extending the full height of the wall panels 18, 20 from the bottom 16 to the top end 14, but need not do so. For example, slidable corner support 50 may extend from the top down to only half the height of the wall panel 18.

The first and second inner panels 40, 46 can take the form of a reinforcing panel covering a substantial portion of the inner face 17 of the wall panels 18, 20 as shown in the figures. Such reinforcing is disclosed, for example, in U.S. Pat. No. 3,731,873 which is hereby incorporated by reference. While such a large reinforcing panel offers added strength and works well with the illustrated embodiment, it is not required. The inner panels could be smaller in width, although a suitable width for adequate gluing and strength should be maintained. In a similar manner, the other wall panels 22, 24 and divider 34 have reinforcing panels as well for added strength.

Figure 6:
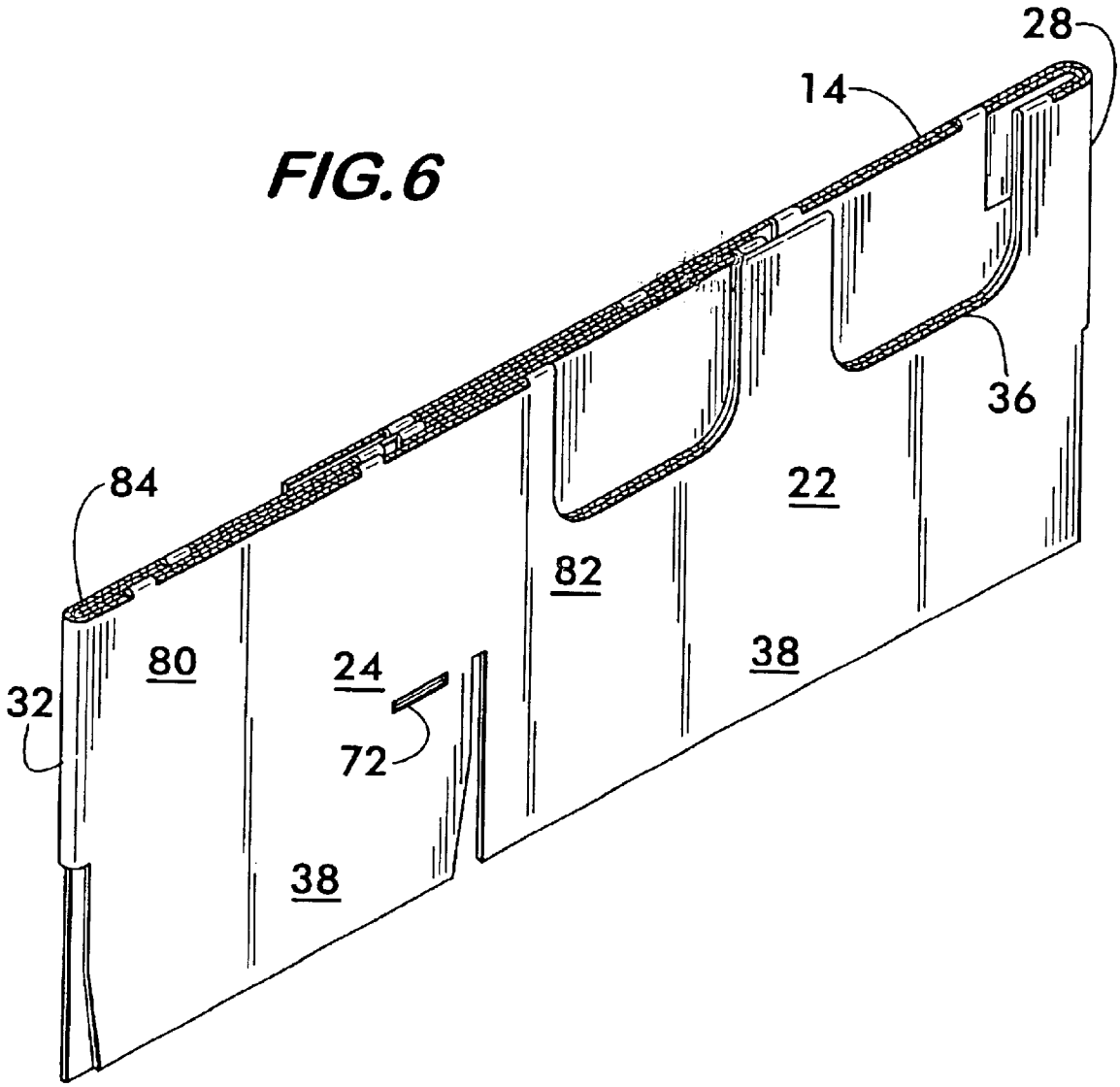
FIG. 6 is a side perspective view of the container 10 in its knockdown state.
Figure 7:
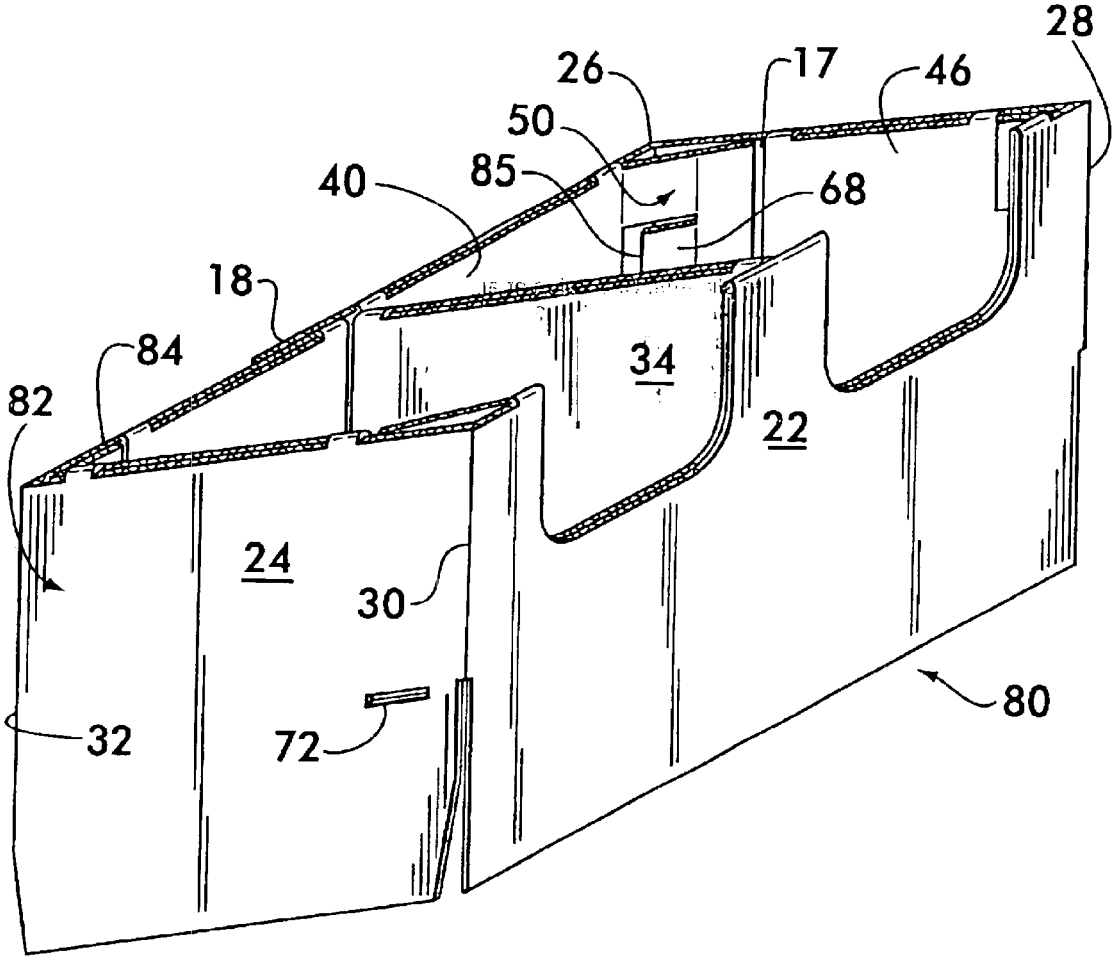
FIG. 7 is a top perspective view of the knockdown of FIG. 6 shown partially opened.

The container 10 is preferably made from a unitary piece of single layer corrugated paperboard which is formed into a knockdown (collapsed) state 80 for easy stacking and shipment to the user. The term "knockdown" refers to the configuration of the container 10 in a flat unassembled form shown in FIGS. 6 and 7 (FIG. 7 showing the knockdown partially opened). The knockdown 80 has a first knockdown wall 82 and a second knockdown wall 84 attached to one another at the second and fourth corners 28 and 32. The first knockdown wall 82 includes the third and fourth wall panels 22 and 24, with the respective integral bottom flaps 38, in a substantially same plane, and the second knockdown wall 84 includes the first and second wall panels 18, 20 with respective integral bottom flaps in a second substantially same plane which is substantially parallel to the plane for the first knockdown wall 82. It is understood that the "substantially" same plane does not mean the exact same plane. The divider wall 34 is sandwiched between and substantially parallel to the knockdown walls 82 and 84.

To assemble the knockdown 80 into the display ready container 10, the two knockdown walls 82 and 84 are pushed apart and folded to form the corners 26 and 30 and create the basic shape of the container 10 (see FIG. 7 showing the knockdown 80 partially opened). As the knockdown is assembled, the corner support 50 moves from a position flat against the walls 18 and 20 (FIG. 6), sliding towards the right until the slidable support member 50 (here the first section 56 thereof) is spaced from the corner 26, and the free end 54 of the slidable support member 50 (here located on the second section 58) moves close to or abuts the side end 48 of the second inner panel 46 as seen in FIGS. 4 and 5. The container bottom flaps 38 are then folded, the tab 70 engaging the tab opening 72. In the illustrated embodiment, as best seen in FIGS. 7 and 4, as the container 10 is opened from the knockdown state, moving the slidable corner 50 to the right, the buttress tab 68 remains parallel to the remainder of the second section 58 of the slidable corner support member 50 even as the second section 58 folds relative to the first section 56 about fold line 60. This causes an end 85 of the buttress tab to move towards the corner 26 as the second section 58 winds up in a face to face relationship with the inner face 17 of the second wall panel 20.

Figure 8:
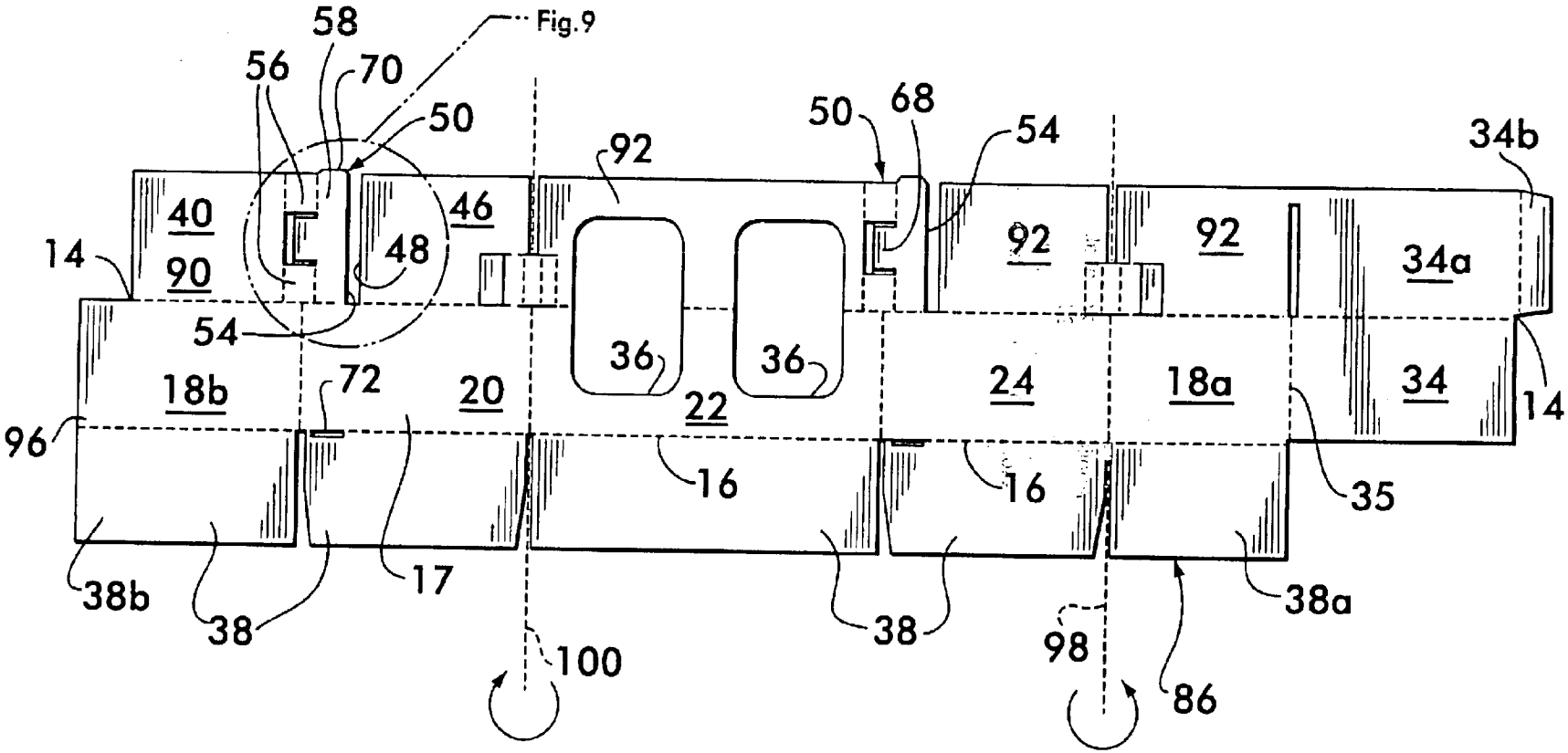
FIG. 8 is a plan view of a blank for forming the container shown in FIG. 1.

Illustrated in FIGS. 8 and 9 is a blank 86 for forming the knockdown 80 and the container 10. The blank 86 is preferably a unitary piece of material such as single layer corrugated paperboard die cut to form the configuration shown. The view of FIG. 8 shows the inner face 17 of the integrally attached wall panels 18*a*, 18*b*, 20, 22, and 24 with respective bottom flaps 38 integrally attached thereto. The divider wall 34 has an integrally connected reinforcing panel 34*a* having a glue tab 34*b*, and is attached to a reinforcing panel 92 which folds over the top end 14 to reinforce panel 18*a*.

The slidable corner supports are formed as shown. A cut out 88 defines the buttress tab 68, the slidable corner support 50 is cut at 89 from the top 14 of the wall panels 18*b*, and 20, and a cut out 95 separates the free end 54 of the slidable corner support 50 from the second inner panel 46.

Fold lines, e.g. fold lines 53 and 60 and wherever fold lines are used to divide sections, can be formed of scores or perforations as known in the art.

The blank 86 can be assembled into the knockdown 80 and the final container 10 as now described with reference to FIGS. 6 and 8. With the blank 86 in a flat position as shown in FIG. 8, the upper panels (40, 46, 92) and divider reinforcing panel 34*a* are folded about a line defining the top end 14 of the container 10 and are secured with glue to the inner face 17 of the respective wall panels 18*a*, 18*b*, 20, 22, 24 and divider panel 34. It is important not to glue the slidable corner supports 50.

The wall panel 18*a* and divider panel 34 (with the integral panels 92 and 34*a* secured thereto) and the partial bottom flap 38*a* integrally attached thereto are then folded, all as a single flat unit, about the line 98 as indicated onto the other panels (FIG. 8) forming the corner 32 at line 98. The glue tab 34*b* of the divider reinforcing panel 34*a* is secured with glue to the area between the two display openings 36. Next, the wall panels 18*b* and 20 (with the top integral panels having been secured thereto as described above) and respective bottom flaps 38 and 38*b* are folded as a flat unit about the line 100 (forming the corner 28 at line 100) and the glue tab 96 is secured with glue to the back side of the partial wall 18*a* and the bottom partial flap 38*b* to partial bottom flap 38*a* to form the complete wall panel 18 and respective bottom flap. This forms a knockdown 80 as shown in FIG. 6 which can be opened and assembled into the container 10 as seen in FIG. 1.

With reference to FIG. 7, it is seen that opening of the knockdown 80 to form the container 10 automatically extends the corner supports 50. Opening the knockdown, i.e., as the angle of the corner 26 between the two wall panels 18 and 20 goes from 180° (knockdown of FIG. 6) to 90° (FIG. 1), the slidable corner support 50 extends away from the corner 26 to be spaced therefrom, the second section 58 of the slidable corner 50 folding relative to the first section 56 and moves towards the end 48 of the second inner panel 46. If the slidable corner 50 were formed of a single section, not the two sections 56 and 58 as illustrated, it is appreciated that this single section would still move away from the corner 26 and its free end 54 could still move toward or abut the end 48 of the second inner panel 46 if dimensioned accordingly. There simply would be no corner support section in a face to face relationship with the inner face 17 of the second wall panel 20 as is provided by the second section 58 of the slidable corner support 50.

Figure 10:
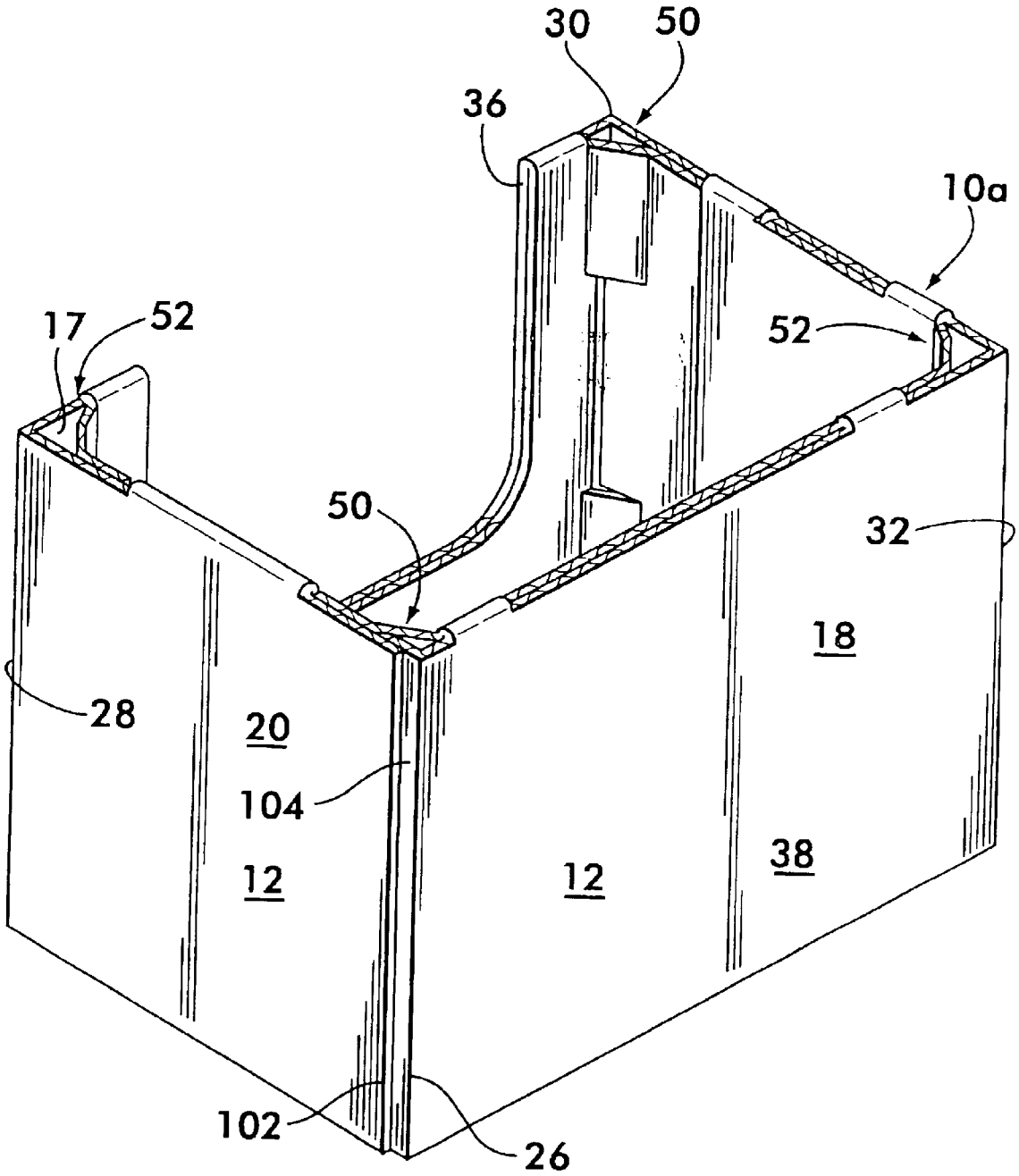
FIG. 10 is a perspective view of another container made in accordance with the present invention, the bottom flaps being in an unfolded position.
Figure 11:
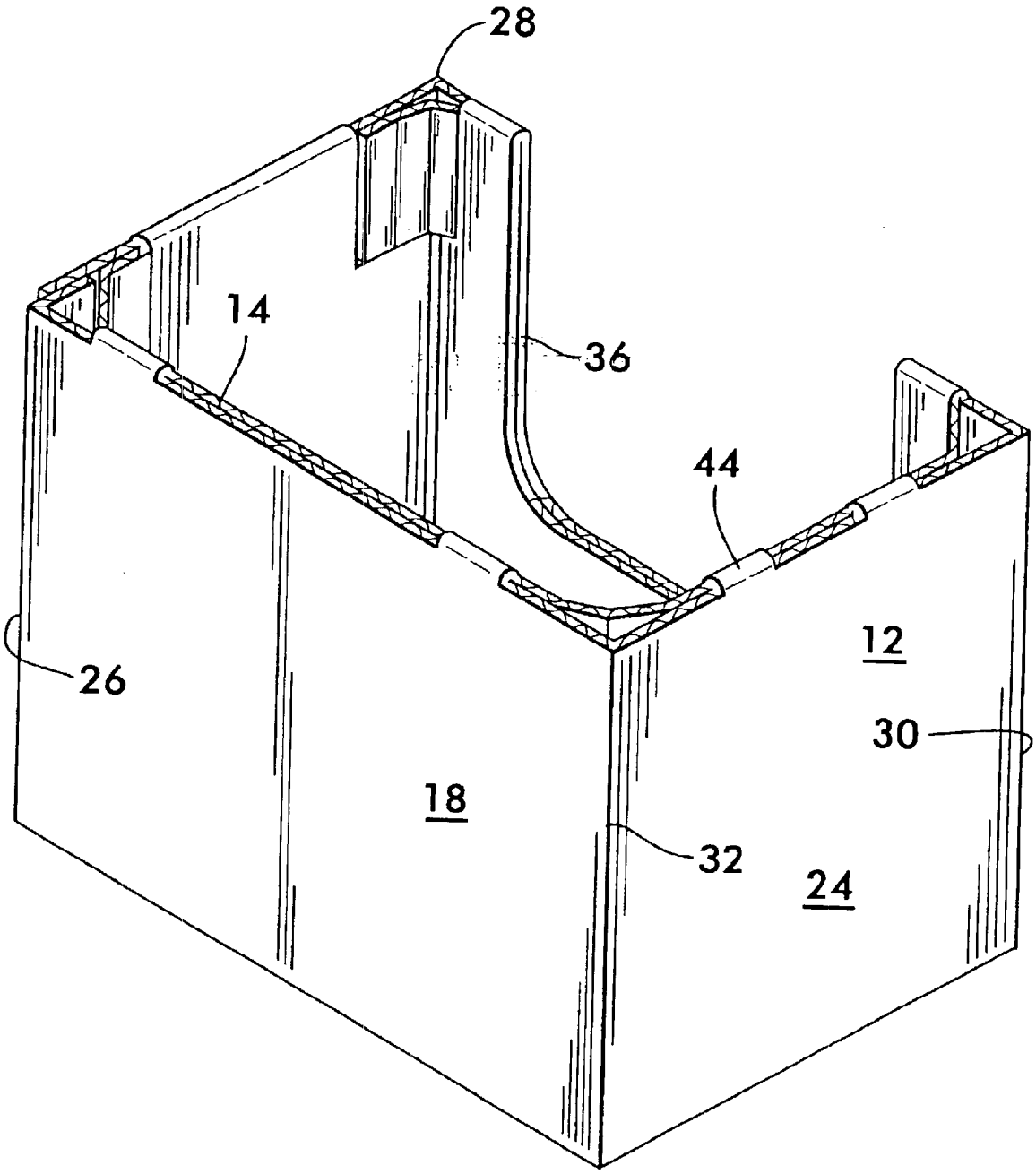
FIG. 11 is another perspective view of the container shown in FIG. 10.
Figure 12:
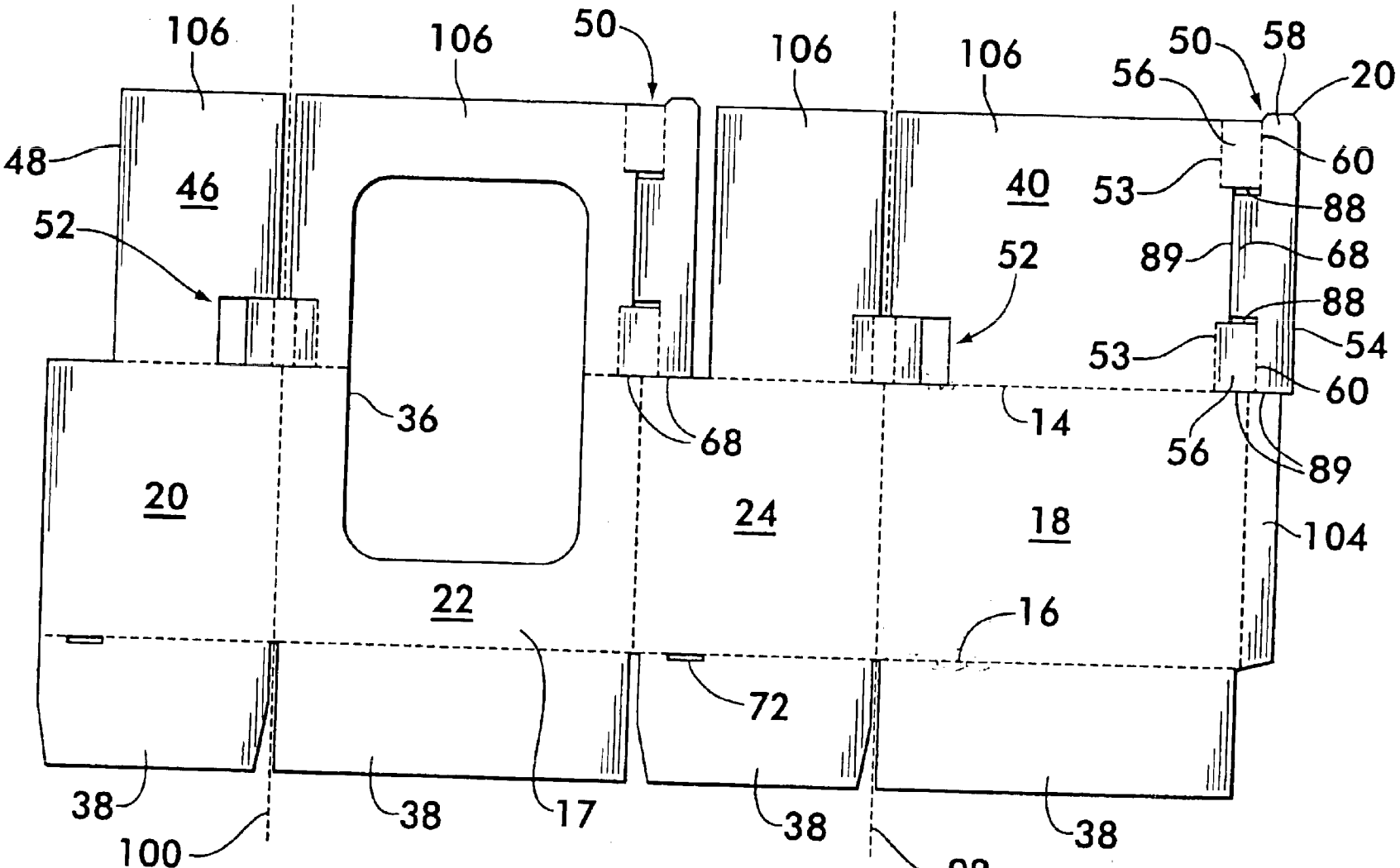
FIG. 12 is a plan view of a blank for forming the container shown in FIG. 10.

Illustrated in FIGS. 10 and 11 is another embodiment of the present invention. Similar elements are referenced with similar reference numbers. This container 10*a* does not have a divider panel and has a single panel forming the panel 18, the wall panels 12 being joined together at the manufacturers joint 102 with a glue tab 104. The slidable support corner 50 is similar to that described above, but has a buttress tab 68 of greater height. A blank 80*a* for forming a knockdown which can be assembled into the container 10*a* is shown in FIG. 12. To make the knockdown, the upper panels 106 are fold about the line 14 onto the inner face of the wall panels 18, 20, 22, and 24 and secured thereto with adhesive such as glue. The slidable corner supports 50 are not to be glued. Wall panel 18 and the integrally attached upper panel 106 and bottom panel 38 are then folded as a single unit about the line 98 which will form the corner 32. Wall panel 20 and the integrally attached upper panel 106 and bottom panel 38 are then folded as a single unit about the line 100 onto the back side of the wall panel 18 (previously folded at line 98) to form the corner 28. Adhesive is applied to the glue tab 104 preferably before the fold about line 100 to form the joint at 102 of wall panels 18 and 20. This forms a knockdown that can be shipped to the user who then may use automated machinery to open and fill the containers.

An alternative design for the slidable corner support 50 of either FIG. 1 or 10 provides a serrated free end 54 that moves towards a correspondingly serrated end 48 of the second inner panel 46. In this manner the two ends 54 and 48 can interlock to help provide added strength. An illustration of this configuration is shown in FIG. 13, this being a detail that could replace the slideable corner 50 detailed in FIG. 9.

While particular embodiments of the invention are described herein, it is not intended to limit the invention to such disclosure. Changes and modifications may be incorporated without departing from the spirit and scope of the present invention. Moreover, the designation of "first," "second," etc., for the various panels and members is not limited to the particular panels or members shown herein.

What is claimed is:

1. A container comprising:

multiple wall panels forming container sides, said wall panels including first and second wall panels which meet one another at a first corner, and a third wall panel which meets said second wall panel at a second corner;

said container being assembleable from a knockdown state to an opened state, wherein said knockdown state has a first and a second knockdown wall, said first knockdown wall including said first and second wall panels substantially parallel to one another in a substantially same first plane, said second knockdown wall including said third wall panel in a second plane which is substantially parallel to said first plane, said first and second wall panels being folded relative to one another at said first corner during the assembly of said container from said knockdown state to said opened state;

a first inner panel attached to said first wall panel, said first inner panel having an end spaced from said first corner; and a slidable corner support attached to said end of said first inner panel and extending towards said second wall panel, said slidable corner support overlapping said first corner when said container is in said knockdown state and having a free end slidable relative to said second wall panel when said container is assembled from the knockdown state, and said slidable corner support moving away from said first corner as said container is assembled from the knockdown state.

2. A container in accordance with claim 1 further comprising a second inner panel attached to and adjacent to said inner face of said second wall panel, said second inner panel having an end spaced from said first corner.

3. A container in accordance with claim 2 wherein said free end of said slidable corner support moves from a position spaced from said end of said second inner panel to a position closer to said end of said second inner panel when said container is assembled from the knockdown state to the opened state.

4. A container in accordance with claim 1 wherein said first inner panel is attached integrally to a top end of said first wall panel.

5. A container in accordance with claim 1 wherein said slidable corner support has a height substantially the same as a height of said first wall panel.

6. A container in accordance with claim 1 wherein said slidable corner support has a height substantially the same as a height of said first inner panel and a height of said first wall panel.

7. A container in accordance with claim 1 wherein said slidable corner support comprises first and second sections foldable relative to one another about a fold line which is substantially parallel to said first corner and which is positioned between said end of said first inner panel and said free end of said slidable support corner support, said first section overlapping said first corner when said container is in said knockdown state, said free end of said slidable corner support being positioned on said second section of said slidable corner support.

8. A container in accordance with claim 7 wherein said first section of said slidable corner support comprises a top section and a bottom section spaced from one another.

9. A container in accordance with claim 8 wherein said second section of said slidable corner support comprises a buttress tab extending towards said first corner between said top and bottom sections when said container is in the assembled state.

10. A container in accordance with claim 7 wherein said first section of said slidable corner support comprises a top section and defines an open area below said top section, said second section of said slidable corner support comprises a buttress tab extending towards said first corner when said container is in said assembled state.

11. A container comprising:

multiple wall panels forming container sides, said wall panels including first, second, and third wall panels, said first and second wall panels meet one another at a first corner, said second and third wall panels meet one another at a second corner;

said container being assembleable from a knockdown state to an opened state, wherein said knockdown state has a first and a second knockdown wall, said first knockdown wall including said first and second wall panels substantially parallel to one another in a substantially same first plane, said second knockdown wall including said third wall panel in a second plane adjacent and substantially parallel to said first plane, said first and second wall panels being folded relative to one another at said first corner during the assembly of said container from said knockdown state to said opened state;

a first inner panel attached to said first wall panel in a face to face relationship therewith along an inner face of said first wall panel, said first inner panel having an end spaced from said first corner; and a slidable corner support attached to said end of said first inner panel and extending towards said second wall panel, said slidable corner support overlapping said first corner when said container is in said knockdown state, said slidable corner support having a free end slidable relative to said second wall panel, said slidable corner support moving away from said first corner as said container is assembled from the knockdown state to the opened state, and said free end moving relative to said second wall panel away from said first corner towards said second corner as said container is assembled from the knockdown state to the opened state.

12. A container in accordance with claim 11 wherein said slidable corner support comprises first and second sections foldable relative to one another about a fold line positioned between said end of said first inner panel and said free end, said first section overlapping said first corner when said container is in said knockdown state, said first section moving away from said first corner towards a center of said container as said container is assembled from the knockdown state to the opened state.

13. A container in accordance with claim 12 wherein said first section of said slidable support member comprises a top section and defines an open area below said top section, said second section of said slidable support member comprises a buttress tab extending towards first corner into said open area when said container is in said open state, said buttress tab overlapping said first corner when said container is in the knockdown state.

14. A container in accordance with claim 11 wherein said slidable corner support comprises a locking tab positioned along a bottom of said slidable corner support, and said container further comprising a bottom flap having an opening engagable by said locking tab when said container is in the opened state.

15. A container comprising:

multiple wall panels forming container sides, said wall panels including first, second, third and fourth wall panels, said first and second wall panels attached to one another at a first corner, said second and third wall panels attached to one another at a second corner;

said container being assembleable from a knockdown state to an opened state, wherein said knockdown state has a first and a second knockdown wall attached to one another at said second corner, said first knockdown wall including said first and second wall panels substantially parallel to one another in a substantially same first plane, said second knockdown wall including said third and fourth wall panels substantially parallel to one another in a substantially same second plane that is adjacent and substantially parallel to said first plane, said first and second wall panels being folded relative to one another at said first corner during the assembly of said container from said knockdown state to said opened state;

a first inner panel attached to said first wall panel in a face to face relationship therewith along an inner face of said first wall panel, said first inner panel having an end spaced from said first corner;

a second inner panel attached to said second wall panel, said second inner panel having an end spaced from said first corner;

a slidable corner support attached to said end of said first inner panel and extending towards said second wall panel, said slidable corner support overlapping said first corner when said container is in said knockdown state, said slidable corner support having a free end slidable relative to said second wall panel, said slidable corner support moving away from said first corner as said container is assembled from the knockdown state to the opened state, and said free end moving relative to said second wall panel towards said end of said second inner panel as said container is assembled from the knockdown state; and bottom forming flaps for forming the bottom of the container.

16. A container in accordance with claim 15 wherein said slidable corner support comprises first and second sections foldable relative to one another about a fold line which is substantially parallel to said first corner and which is positioned between said end of said first inner panel and said free end, said first section overlapping said first corner when said container is in said knockdown state, said free end of said slidable corner support being positioned on said second section of said slidable corner support.

17. A container in accordance with claim 16 wherein said first section of said slidable corner support comprises a top section and defines an open area below said top section, said second section of said slidable corner support comprises a buttress tab extending towards said first corner when said container is in said assembled state.

18. A container in accordance with claim 17 wherein said free end is serrated, and said end of said second inner panel is correspondingly serrated so as to be capable of interlocking with the free end.

19. A container in accordance with claim 3 wherein said free end and said end of said second inner panel are configured to interlock together when said container is in the opened state.

20. A container in accordance with claim 3 wherein said slidable corner support has a bottom end, said bottom end being supported by another member of said container.

* * * * *